United States Patent [19]

Asselin

[11] Patent Number: 4,545,163

[45] Date of Patent: Oct. 8, 1985

[54] HEAT INSULATED TIE ROD FOR CONCRETE WALL MEMBERS

[76] Inventor: Ovila Asselin, 351 rue Principale, Eastman, (Quebec), Canada, J0E 1P0

[21] Appl. No.: 566,291

[22] Filed: Dec. 28, 1983

[30] Foreign Application Priority Data

Nov. 15, 1983 [CA] Canada ..... 441173

[51] Int. Cl.[4] ..... E04B 2/04; E04G 17/08

[52] U.S. Cl. ..... 52/378; 52/405; 52/562; 52/410; 249/40; 249/213; 249/215; 249/218

[58] Field of Search ..... 249/213, 214, 215, 216, 249/217, 218, 38, 40; 264/256; 52/612, 378, 379, 405, 410, 562, 565, 426, 428, 309.12

[56] References Cited

U.S. PATENT DOCUMENTS

| | | | |
|---|---|---|---|
| 1,137,416 | 4/1915 | Mumford | 249/217 |
| 1,259,442 | 3/1918 | Ramm et al. | 249/213 |
| 1,486,499 | 3/1924 | Taylor | 249/38 |
| 1,518,955 | 12/1924 | Backlund | 249/215 |
| 1,663,104 | 3/1928 | Wales | 249/213 |
| 1,951,421 | 3/1934 | Kleitz | 249/213 |
| 2,546,043 | 3/1951 | Parmenter | 249/213 |
| 2,653,469 | 9/1953 | Callan | 72/50 |
| 3,000,144 | 9/1961 | Kitson | 50/268 |
| 3,295,278 | 1/1967 | Muhm | 52/223 |
| 3,734,453 | 5/1973 | Bailey | 249/213 |
| 3,750,355 | 8/1973 | Blum | 52/309 |
| 3,757,482 | 9/1973 | Haeussler | 52/405 |
| 3,879,908 | 4/1975 | Weisman | 52/309 |
| 3,881,684 | 5/1975 | Daniels, Jr. | 249/40 |
| 3,922,413 | 11/1975 | Reineman | 428/119 |
| 3,927,857 | 12/1975 | Lovisa et al. | 249/217 |
| 3,996,713 | 12/1976 | Haeussler | 52/309 |
| 4,117,639 | 10/1978 | Steenson et al. | 52/223 R |
| 4,208,030 | 6/1980 | Wilson | 249/217 |
| 4,283,896 | 8/1981 | Fricker et al. | 52/410 |
| 4,329,821 | 5/1982 | Loag et al. | 52/309 |

FOREIGN PATENT DOCUMENTS

| | | | |
|---|---|---|---|
| 142587 | 8/1951 | Australia | 249/218 |
| 141261 | 4/1920 | United Kingdom | 249/213 |

*Primary Examiner*—Jay H. Woo
*Assistant Examiner*—James C. Housel
*Attorney, Agent, or Firm*—Keil & Weinkauf

[57] ABSTRACT

An improved heat insulated tie rod allowing to reduce local heat insulation defects of concrete or stratified, concrete wall members. The tie rod includes stoppers for setting and holding together a pair of frame walls in spaced apart relationship with, if desired, a heat insulating panel therebetween. The tie rod is improved in that it is made of two coaxial portions connected to each other through a central, heat insulated body having a high resistance to crushing. Preferably, each tie rod portion has a looped end surrounding the central body which can be a block of hardwood.

16 Claims, 4 Drawing Figures

HEAT INSULATED TIE ROD FOR CONCRETE WALL MEMBERS

BACKGROUND OF THE INVENTION (a) Field of the Invention

The present invention relates to a heat insulating tie rod for setting and holding together, a pair of frame walls in spaced apart relationship with, if desired, a heat insulating panel therebetween.

(b) Brief Description of the Prior Art

Concrete is a highly valuable building material to make fireproof dwelling buildings. However, concrete also has a very poor performance as heat insulator, which lead building's landlords to spend large amount of money to heat or refrigerate them.

In order to substantially increase the effective heat resistance of concrete wall members cast on the premises such as foundations, walls, floors, roof decks, etc., it has already been proposed to juxtapose or fix conventional heat insulating material on at least one surface of the wall member by means of adhesive, nails and the like.

It has also been proposed to embed a heat insulating material in the concrete when pouring the same to form a stratified, concrete wall member. To obtain such a member, tie rods are used for rigidly setting and holding a pair of frame walls in spaced apart relationship. A heat insulating panel is positioned between these frame walls by means of spacing members, and then concrete is poured. Once the concrete has hardened, the tie rods remain in the resulting member to hold the slabs of concrete and the panel together. However, these tie rods and spacing members create heat conduction bridges that locally impair the heat insulation efficiency of the so obtained stratified, concrete wall members.

SUMMARY OF THE INVENTION

An object of the present invention is to provide a heat insulated tie rod that overcomes the mentioned drawback, namely the presence of heat conduction bridges due to the tie rods and spacing members used during the manufacturing of concrete wall member or stratified, concrete wall member.

Another object of the invention is to provide a heat insulated tie rod which, when used for the manufacture of a stratified, concrete wall member, acts as a spacing member for rigidly setting and holding a heat insulating panel between the spaced apart frame walls, prior to pouring concrete between said frame walls. Such a tie rod contributes to simplify and make easier the manufacturing of stratified, concrete wall members.

In accordance with the invention, these objects are achieved with an improved tie rod for setting and holding together a pair of frame walls in spaced apart relationship with, if desired, a heat insulating panel therebetween. This tie rod is improved in that it is made of two coaxial portions connected to each other through a central, heat insulating body having a high resistance to crushing.

Preferably, each tie rod portion has a looped end surrounding the central body. Each tie rod portion advantageously consists of a rod, especially a rod of circular cross section, or of a strap made of cold rolled steel having one end bent and eventually spot-welded or riveted on itself to define the looped end.

The loops are preferably embedded in grooves provided in the outer surfaces of the central body. The loops of the tie rod portions advantageously extend in planes perpendicular to each other with respect to the longitudinal axis of the tie rod. When each tie rod portions consists of a strap, one of the tie portion may be twisted at 90° near the loop for the purpose of keeping both straps in a same plane.

The central body is advantageously a block made of a material selected in the group consisting of plastics and hardwoods such as maple, oak, birch, elm, etc. This central body advantageously has a spheric or a parallelepipedic structure, and when it is made of hardwoods, it may optionally be treated with a wood preservative such as creosote.

In order to set and hold a pair of frame walls in a spaced apart relationship with, if desired, a heat insulating panel therebetween, prior to pouring concrete between said frame walls, and to allow easy removal of the frame walls when the poured concrete has hardened, each tie rod portion advantageously comprises at least two pairs of notches grooved in the lateral sides of the tie rod portion perpendicularly to the longitudinal axis of the tie rod. Two thin U-shaped stoppers may be inserted into each pair of notches of a tie rod portion. Two pairs of notches of one tie rod portion are intended to be adjacent to opposite surfaces of one wall of the spaced apart frame walls. When these spaced apart frame walls contain a heat insulating panel therebetween, a third pair of notches, identical to the other ones, is grooved in the tie rod portion. This third pair is located so as to be adjacent to one of the outer surface of a heat insulating panel, and a third U-shaped stopper is inserted into said third pair of notches. This third notch-stopper arrangement, together with the third notch-stopper arrangement of the opposite tie rod portion, firmyl holds and sets the insulating panel between the frame walls prior to and during pouring of concrete.

The above-mentioned pairs of notches are advantageously made, when the tie rod portion is a rod or a strap of colled rolled steel, by the bilateral squeezing of the tie rod portions with an adequate press working apparatus.

The invention also relates to a frame wall assembly for the manufacturing of a concrete wall member or of a stratified, concrete wall member, said assembly comprising at least two frame walls sections held in a spaced apart relationship by means of at least one tie rod according to the invention, each frame wall section being fixed to the end of the corresponding tie rod portion between two parallel stoppers respectively engaged in two corresponding pairs of notches provided in said portion. Of course for the manufacturing of a stratified, concrete wall member, this assembly further comprises at least one heat insulating panel section that is set and held between the spaced apart frame wall sections.

According to a preferred embodiment of the invention, the stopper that is adjacent to the outer surface of the frame wall section consists of a metal hook pivotably mounted at one end of a thin strip of metal that is fixed on the outer surface of a frame wall section. The opposite end of this strip is provided with a perforation to be engaged by another and parallel tie rod portion, so that by the rigid interconnection of at least two tie rods portions, two juxtaposed and coplanar frame wall sections can be rigigly set and hold togther to thus provide a greater surface for the resulting frame wall.

Advantageously, the stoppoer that is adjacent to the inner surface of the frame wall section and/or the stopper that is adjacent to the corresponding outer surface of the heat insulating panel, consists of a thin strip of metal or of plastics connecting at least two parallel tie rod portions to each other for rigidly interconnecting at least two frame wall sections and/or at least two heat insulating panel sections, respectively.

To manufacture a stratified, concrete wall member, the central body is advantageously embedded in a corresponding opening provided in the heat insulating panel. Preferably, this opening is provided in the tongue and groove joint of two panels section juxtaposed to each other by their lateral sides.

Also, when a stratified, concrete wall member is to be manufactured, each tie rod portion may further be provided with at least one locking means for solidly interconnecting and holding together the slabs of concrete and the heat insulating panel. This means preferably consists of at least one washer or one parallelepipedic element, advantageously two washers or parallelepipedic elements, perpendicularly mounted on the tie rod portion with respect to its longitudinal axis. Advantageously, when the tie rod portions are made of cold rolled steel, said washers or parallelepipedic elements are also made of such a steel and they are spot-welded on said portion.

The heat insulating panel is preferably made of a material having a low water absorption coefficient and a high resistance to impact. It is advantegeously made of an extruded and expanded polystyrene. This heat insulating panel may be further provided with a netting of metal or of fiber glass in the middle of its thickness, to increase its resistance to impact.

A further object of the invention is to provide a concrete wall member or a stratified, concrete wall member having substantially reduced local heat insulation defects by heat conduction through the tie rods. Such a member is obtained by pouring a concrete between a pair of spaced apart frame walls or a pair of spaced apart frame walls containing a heat insulating panel therebetween, said frame walls or frame walls and panel being rigidly set and hold together on the premise, by means of several tie rods of the type described hereinabove. Once the concrete has hardened, the frame walls are removed from the resulting member and the tie rod parts which stick out of the resulting member are cut with bolt-cutter or broken by bending.

BRIEF DESCRIPTION OF THE DRAWINGS

The present invention will be better understood with reference to the following nonrestrictive description of a preferred embodiment thereof, taken in connection with the following drawings wherein.

DESCRIPTION OF A PREFERRED EMBODIMENT

Figure 1:
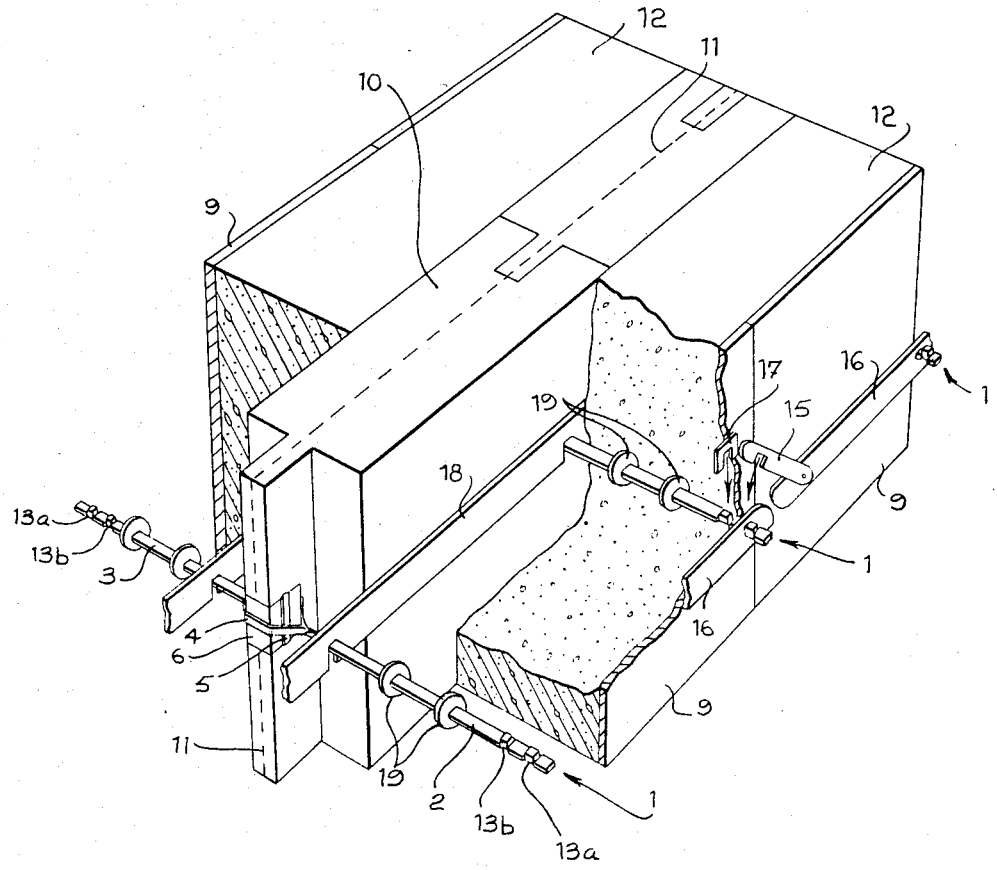
FIG. 1 is a partial perspective view of a stratified, concrete wall member provided with tie rods according to the invention.
Figure 4:
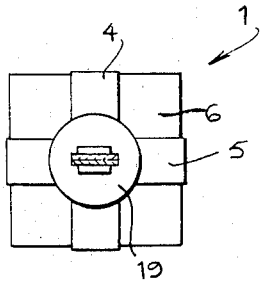
FIG. 4 is an end elevational view of the tie rod shown in FIG. 2.
Figure 2:
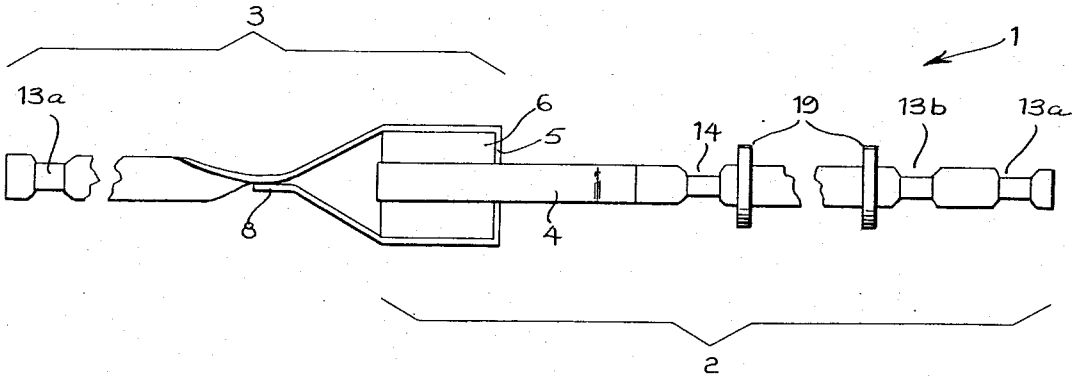
FIG. 2 is a top plan view of a tie rod according to the invention.
Figure 3:
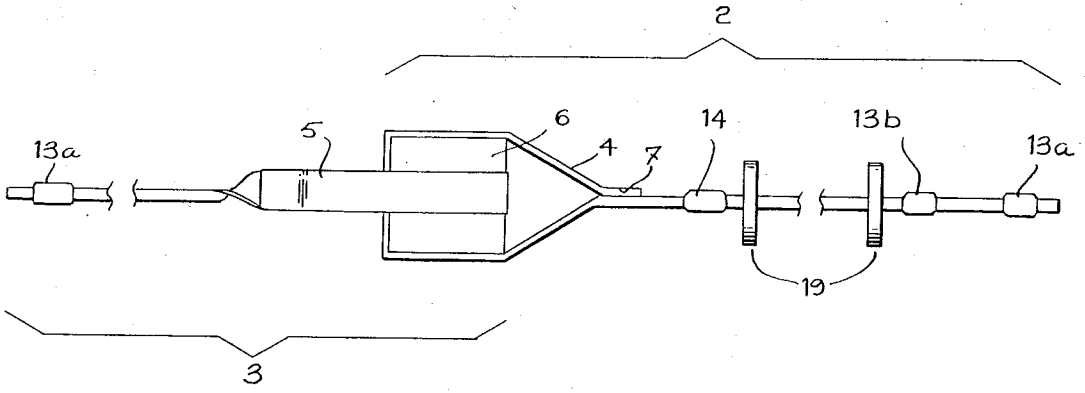
FIG. 3 is a side elevational view of the tie rod shown in FIG. 2.

The tie rod 1 according to the invention, as shown in FIGS. 2 to 4, comprises a parallelepipedic central body 6 and two tie rod portions 2 and 3 connected to each other by engagement of two loops 4 and 5 provided at the ends of the portions 2 and 3 respectively, into corresponding groove provided in the outer surfaces of the body 6.

The loop 4 consists of a part of the tie rod portion 2, bent to fit in the corresponding groove provided in the central body 6. The free end 7 of the bent part is spot-welded on the lateral side of the tie portion 2 to define the closed loop 4. Loop 5 is identical to loop 4. Furthermore, the tie rod portion 3 is twisted at 90° near its free end 8 to set both tie rod portions 2 and 3 in coplanar relationship.

Each tie rod portion 2 or 3 is provided with means for setting and holding in a spaced apart relationship a pair of frame walls 9, and a heat insulating panel 10 comprising a netting 11 in the middle of its thickness to increase its resistance to impact.

These means consists of three pairs of notches 13*a*, 13*b* and 14, each pair being intended to be engaged by a corresponding stopper. The stopper of notches 13*a* consists of a metal hook 15 pivotably mounted at one end of a thin strip 16 fixed to the outer surface of a frame wall section of the frame wall 9. The opposite end of the strip 16 is provided with an opening for receiving another, parallel tie rod portion. This interconnection of two tie rods portions permits to firmly set and hold together two adjacent, coplanar frame wall sections. The stopper of notches 13*b* consists of a thin U-shaped stopper 17. This stopper 17 prevents free sliding of the frame wall section along the tie rod portions before and during filling of the framework with concrete. The stopper of notches 14 consists of a thin strip 18 interconnecting several tie rod portions to each other to increase the rigidity of the framework in addition to setting and holding the heat insulating panel 10 inside the framework together with the strip 18 of the opposite tie rod portion 3 or 2.

The tie rod portion 2 and 3 are also provided with means between notches 13*b* and 14 for rigidly holding the slabs 12 and the panel 10 together. These means consist of two washers 19 concentrically mounted and fixed by spot-welding onto the tie rod portions.

The manufacture of a stratified, concrete wall member with tie rods 1 according to the invention can be carried out as follows.

(1) A stopper 17 is firstly engaged in the pair of notches 13*b* of all of the tie rod portions 2. A first frame wall section and the opening of the strip 16 of an adjacent second frame wall section are set between the pairs of notches 13*a* and 13*b*, and a hook 15 belonging to the strip 16 of the first frame wall section is shut down in the pair of notches 13*a*, thereby firmly interconnecting two adjacent, coplanar frame wall sections together. Additional coplanar frame wall sections may be similarly added to reach the desired size of the frame wall 9.

(2) Secondly, a strip 18 is engaged in the pair of notches 14 of several tie rod portions 2. The heat insulating panel 10 then is set against the strip 18 between two rows of parallel tie rods 1, the central body of the tie rods fitting into an opening provided in the tongue of the panel 10. Another strip 18 is engaged in a pair of notches 14 of several tie rod portions 3 thus to firmly set and hold the panel 10 with respect to the frame wall 9.

(3) The steps recited in paragraph (1) above are repeated for the tie rod portions 3 thus to complete the framework.

(4) The concrete is poured in the framework and allowed to harden. Thereafter, the frame walls 9 are removed by disengaging the hooks 15 from the pairs of notches 13*a*. The tie rod parts which extend out of the so obtained stratified, concrete wall member are cut with a bolt-cutter or merely broken by bending.

To manufacture a mere concrete wall member, one can follow the above recited procedure while skipping paragraph (2).

What is claimed is:

1. A tie rod for setting and holding together a pair of frame walls in spaced apart relationship with, if desired, a heat insulating panel therebetween, said tie rod being made of two separate coaxial portions each having a loop interlinked with a loop on the other coaxial portion and connected to each other by a central, heat insulating body extending through and spacing said loops, said body having a high resistance to crushing.

2. The tie rod of claim 1, wherein the loops of the tie rod portions extend in planes perpendicular to each other with respect to the longitudinal axis of the tie rod.

3. The tie rod of claim 2, wherein the loop of each tie rod portion is embedded in a groove provided in the outer surface of the central body.

4. The tie rod of claim 1, wherein the central body is a block made of hardwood.

5. The tie rod of claim 1, wherein each tie rod portion consists of a rod or a strap made of cold rolled steel, said rod or strap having one end bent and spot-welded or riveted on itself to define said looped end.

6. The tie rod according to claim 1, comprising at least two pairs of notches grooved in the lateral sides of each tie rod portion perpendicularly to the longitudinal axis of the tie rod, said notches being used for setting and holding the pair of frame walls in spaced apart relationship.

7. The tie rod of claim 1, wherein each tie rod portion is provided with at least one means for locking said portion in the concrete.

8. The tie rod of claim 7, wherein each of said locking means consists of a washer perpendicularly fixed onto the corresponding portion with respect to the longitudinal axis of the tie rod.

9. An improved frame wall assembly for the manufacturing of a concrete wall member, said assembly comprising at least two frame walls sections held in a spaced apart relationship by means of at least one tie rod, said tie rod having two separate coaxial portions each with interlinked loops spaced by an insulating body extending through said loops, said insulating body having a high resistance to crushing each frame wall section being fixed to an end of one tie rod portion opposite said loops and between two parallel stoppers respectively engaged in two corresponding pairs of notches provided in said end of said one tie rod portion.

10. A frame wall assembly according to claim 9, wherein the stopper that is adjacent to the outer surface of the frame wall section consists of a metal hook pivotably mounted at one end of a thin strip of metal fixed to the outer surface of the frame wall section, the opposite end of said strip being provided with a perforation to be engaged by another and parallel tie rod portion, so that by rigidly connecting two tie rods portions togther, two juxtaposed and coplanar frame walls sections can be rigidly set and held together.

11. A frame wall assembly according to claim 10, wherein the stopper that is adjacent to the inner surface of the frame wall section, consists of a thin strip of metal which connects at least two parallel tie rod portions to each other, for the purpose of rigidly setting and holding at least two frame walls sections togther.

12. A frame wall assembly according to claim 9, for use togther with at least one central heat insulating panel, wherein the means for setting and holding this panel between the frame walls sections comprises for each tie rod, a third pair of notches in each said tie rod portion nearer said loop and adjacent to the corresponding surface of said panel, and a stopper engaged therein and consisting of a thin strip of metal connecting at least two parallel tie rods to each other, the said insulating body of each tie rod being embedded in a corresponding opening provided in the heat insulating panel.

13. A frame wall assembly according to claim 12, wherein the opening is provided at the junction of two heat insulating panels that are juxtaposed to each other by their lateral sides.

14. A frame wall assembly according to claim 12, wherein the heat insulating panel is provided in the middle of its thickness with a netting to increase its resistance to impact.

15. An improved stratified, concrete wall member comprising a heat insulating panel positioned between two parallel slabs of concrete, the improvement wherein, a plurality of tie rods according to claim 1 are embedded within said member so as to mechanically connect both slabs of concrete while avoiding heat conduction through the length of the tie rod.

16. An improved tie rod according to claim 1, for setting and holding together a pair of frame walls in a spaced apart relationship with, if desired, a heat insulating panel therebetween, said tie rod being made of two coaxial tie rod portions made of steel, connected to each other through a central, heat insulating body, one end of each tie rod portion being provided with means intended to positively engage a corresponding frame wall portion, and means intended to lock it inside the concrete bulk, the improvement wherein each tie rod portion has its end opposite to the one intended to engage a corresponding frame wall portion, bent and spot-welded or riveted on itself to define a loop that surrounds and positively engages the heat insulating body, so as to apply, in use a compressive force to said body, the loop of one tie rod portion being, with respect to the longitudinal axis of the entire rod, in a plane perpendicular to the loop of the other tie rod portion, the loop of each portion having no direct contact to each other, and the heat insulating body having a high resistance to crushing.

* * * * *